United States Patent [19]

Brand

[11] 4,031,357

[45] June 21, 1977

[54] SAFETY CHECK BILL RECEPTACLE

[76] Inventor: Wayne R. Brand, 21 Buena Vista, Corte Madera, Calif. 94925

[22] Filed: Feb. 20, 1976

[21] Appl. No.: 659,719

[52] U.S. Cl. ..... 235/12; 235/7 R; 235/7 A; 235/22

[51] Int. Cl.[2] ..... G07G 1/00

[58] Field of Search ..... 235/7 R, 7 A, 22, 12; 232/15, 16; 133/2; 194/1 R; 197/180; 109/46, 66; 46/2, 4, 5

[56] References Cited

UNITED STATES PATENTS

| | | | |
|---|---|---|---|
| 693,473 | 2/1902 | Wessells | 235/7 R |
| 1,553,694 | 9/1925 | Johnson et al. | 235/7 R X |
| 1,998,773 | 4/1935 | Warren | 235/22 |
| 2,064,562 | 12/1936 | Pasinski | 235/22 |
| 2,535,743 | 12/1950 | Lundahl | 197/180 |
| 3,215,147 | 11/1965 | Johnson | 133/2 |
| 3,654,433 | 4/1972 | Mendoza | 235/7 A |
| 3,690,332 | 9/1972 | Dykehouse et al. | 132/2 |
| 3,934,693 | 1/1976 | Ooyama et al. | 194/4 R |

*Primary Examiner*—Ulysses Weldon
*Attorney, Agent, or Firm*—Robert D. Farkas

[57] ABSTRACT

A receptacle is mounted on the front plate of a cash register to hold and receive paper money bills. A slidable arm extends through a slot in the vertical wall of the receptacle and cash register to contact a bill placed on the bottom shelf of the receptacle. After a transaction is completed, the "sale" button on the register is pressed to actuate a motor driven cam and linkage which draw the arm and bill through the slot to deposit the bill in the cash register. The receptacle may include a tray for holding various items such as pens and pencils. Display of the bill submitted by a customer during a transaction avoids errors and disputes concerning the denomination of the bill.

3 Claims, 3 Drawing Figures

SAFETY CHECK BILL RECEPTACLE

BACKGROUND OF THE INVENTION

1. Field of the Invention

The present invention relates to receptacles for paper money bills and particularly to a device mounted externally on a cash register to hold and receive such bills.

2. Description of the Prior Art

The usual cash register does not have any external device for holding and displaying a paper money bill involved in a sales transaction or to hold various items such as pens and pencils. The bills or other items may be placed loosely on the shelf or counter supporting the register, or the bill can be placed directly in the cash drawer. Careless handling of the bill can result in errors and disputes as to the denomination and loose items can easily be lost. While various tray attachments have been used with other apparatus, such as shown in U.S. Pat. Nos. 2,535,743, issued Dec. 26, 1950 and 3,343,772, issued Sept. 26, 1967, none were used specifically for mounting on a cash register for holding and receiving bills and other articles.

SUMMARY OF THE INVENTION

It is therefore the primary object of the present invention to provide a novel receptacle mounted externally on a cash register to hold and receive paper money bills and other articles.

This is accomplished by mounting a receptacle on the front plate of a cash register over the cash drawer. The bill is placed on the bottom shelf of the receptacle under a slidable arm which extends through a slot in the rear vertical wall of the receptacle and the front plate of the register. When a transaction is completed, the operator pushes the sale button on the register which is connected to a small electric motor. The motor drives a cam and linkage connected to the arm which draws the bill into the slot to deposit it in the cash register. Another portion of the receptacle may include a tray for holding various other articles. Other objects and advantages will become apparent from the following description in conjunction with the accompanying drawings.

DESCRIPTION OF THE PREFERRED EMBODIMENTS

Figure 1:
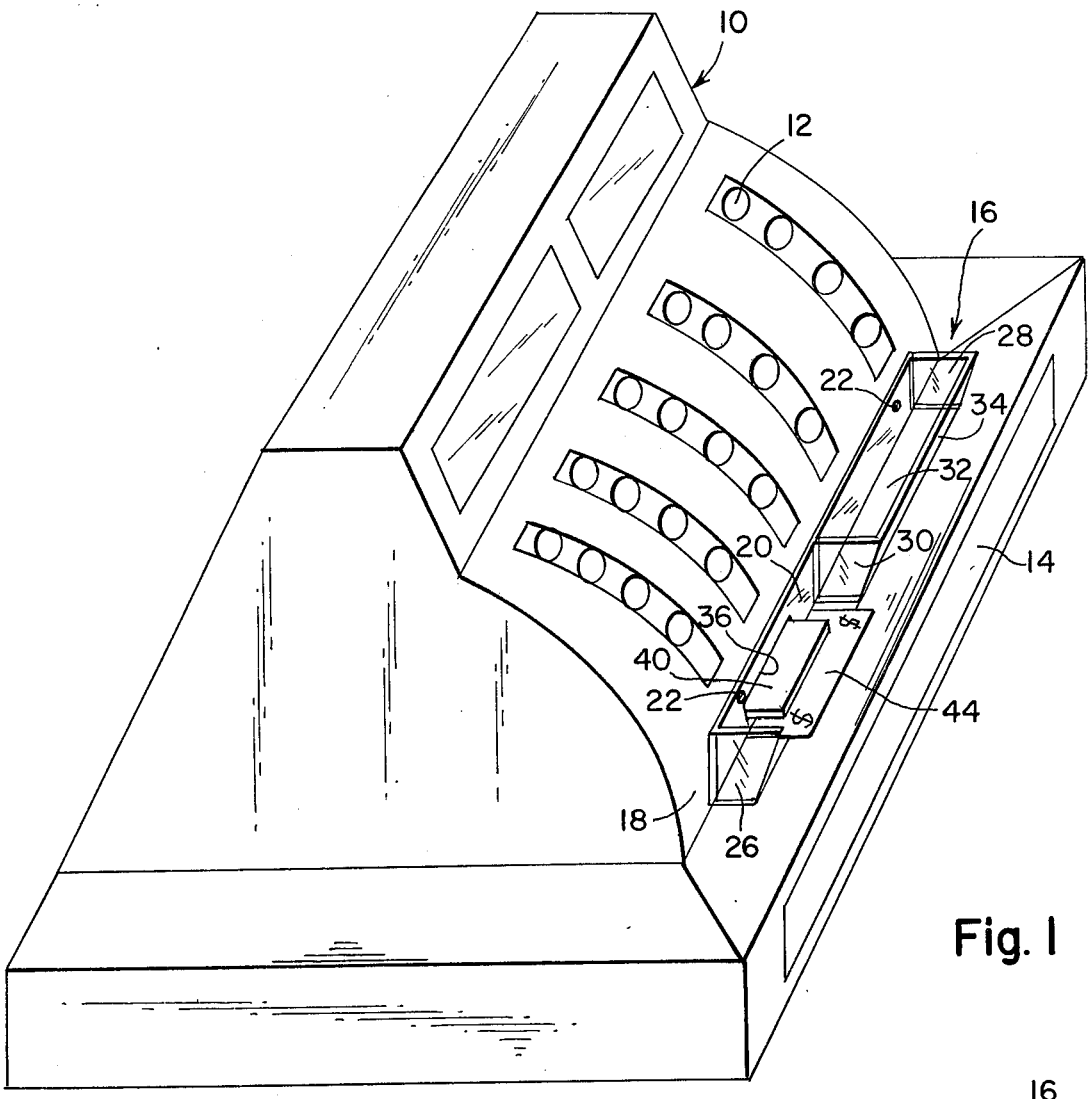
FIG. 1 is a perspective view of a typical cash register incorporating the receptacle of the present invention.

As shown in FIG. 1, a cash register 10 includes a plurality of keys or buttons, one of which is a sale button 12, which are pressed to register a sale and the amount of the transaction. A cash drawer 14 opens when the transaction is registered to permit placing the money in the drawer. Occasionally, through error or misunderstanding there is a question as to the denomination of the paper money bill involved in the last sale. In order to minimize the occurrence of disputes in such cases, a spacial receptacle 16 is mounted on the front plate 18 of the register above the cash drawer 14.

Figure 2:
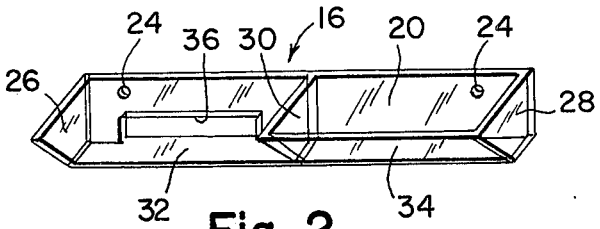
FIG. 2 is a front angled view of the receptacle.
Figure 3:
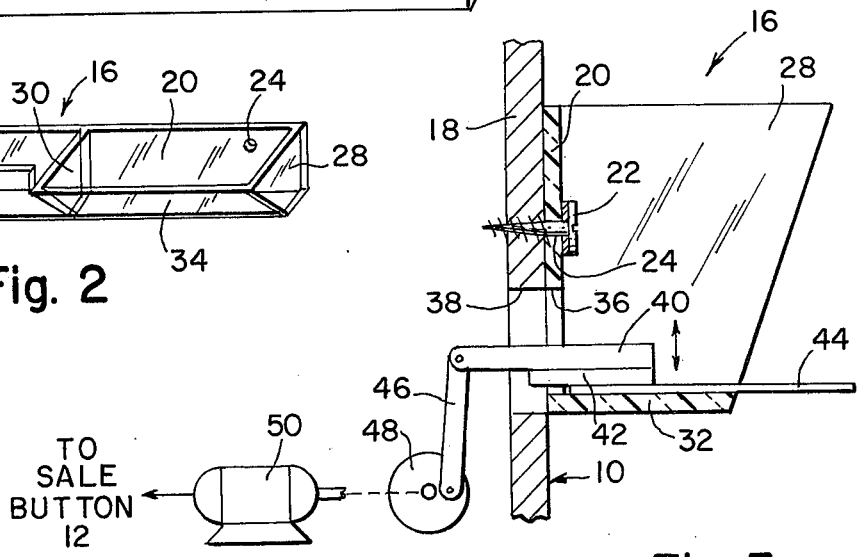
FIG. 3 is a partial cross-section of the receptacle mounted on the register and showing the slot and mechanism for holding and receiving a paper money bill.

As shown in further detail in FIGS. 2 and 3, the receptacle 16 includes a rear vertical wall 20 mounted to front plate 18 by screws 22 through holes 24. The receptacle is divided into two sections by vertical side walls 26, 28 and a central partition 30. A horizontal shelf 32 forms the bottom of the receptacle and an upward sloping wall 34 provides the front wall along the right side of the receptacle between partition 30 and side wall 28. Both sections are open at the top and the left side of the receptacle is open at the front as well. A relatively long narrow slot 36 is formed in rear wall 20 of the left side of the receptacle along the edge of the bottom shelf 32. A matching slot 38 is provided in front plate 18 of the cash register.

Extending through the slot in the register and receptacle is a slidable horizontal arm 40 which rests on bottom shelf 32. A pad 42 of teflon, rubber, or other suitable material, is secured to the bottom of arm 40 to provide a surface which will contact and hold a paper money bill 44 placed on the shelf 32 under arm 40. Arm 40 is connected by a linkage 46 to a cam 48 behind the front plate 18 within the register. The cam is connected to and driven by a small electric motor 50 which is electrically connected to and actuated by the sale button 12 on the top of the cash register.

During a transaction with a customer, the sales person or cashier places the bill involved on the shelf 32 under arm 40 so that the bill is held in place and can readily be seen. Upon completion of the transaction, the sales button 12 on the register is pressed to actuate motor 50 which drives cam 48 and linkage 46 to draw arm 40 and bill 44 through slot 36, 38 into the register where the bill is deposited. This automatic action avoids errors and disputes concerning the bill involved.

The right hand section of the receptacle may be used as a tray or container to hold various other articles such as pens, pencils, pads, rubber stamps and the like. These loose articles are thus maintained in a convenient location to prevent their loss. The entire receptacle is preferably made of a rigid clear plastic material to provide ready visible access to the money bill and various articles. The receptacle may also be mounted by other suitable devices such as rubber suction cups secured to the front plate of the register. While only a single embodiment has been illustrated and fully described, it is apparent that many other variations may be made in the particular design and configuration without departing from the scope of the invention as set forth in the appended claims.

What is claimed is:

1. A receptacle for cash register comprising a rear wall adapted to be mounted on the exterior of the front plate of said register, and a bottom shelf secured to said rear wall, said rear wall including a slot along said bottom shelf, said slot being adapted to receive a paper money bill, said front plate of said register including a matching slot, said rear wall slot being aligned with said matching slot, said register including means for holding a paper money bill on said bottom shelf and for drawing said bill into said register, said means for holding and drawing said bill including an arm extending through said slots and adapted to contact a bill on said shelf, a motor and linkage connected to said arm to draw said arm and bill into said register, and a button on said register for actuating said motor upon completion of a sales transaction, said receptacle including two side walls at opposite ends of said rear wall and bottom shelf, a central partition and a front wall between said partition and one side wall, said slot being positioned between said partition and the other side wall, the portion of said receptacle with said front wall providing a tray for holding articles.

2. The device of claim 1 wherein said rear wall includes means for mounting said receptacle on said plate of said register.

3. The device of claim 2 wherein said receptacle is made of a clear plastic.

* * * * *